US008962231B2

(12) United States Patent
Tamagaki et al.

(10) Patent No.: US 8,962,231 B2
(45) Date of Patent: Feb. 24, 2015

(54) TONER FOR MAGNETIC SINGLE-COMPONENT DEVELOPMENT

(71) Applicant: Kyocera Document Solutions Inc., Osaka-shi (JP)

(72) Inventors: Masashi Tamagaki, Osaka (JP); Takanori Tanaka, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/920,953

(22) Filed: Jun. 18, 2013

(65) Prior Publication Data

US 2013/0344429 A1 Dec. 26, 2013

(30) Foreign Application Priority Data

Jun. 20, 2012 (JP) ..... 2012-139117

(51) Int. Cl.

| | |
|---|---|
| ***G03G 9/087*** | (2006.01) |
| ***G03G 9/097*** | (2006.01) |
| ***G03G 9/08*** | (2006.01) |
| ***G03G 9/083*** | (2006.01) |

(52) U.S. Cl.

CPC ..... *G03G 9/09733* (2013.01); *G03G 9/0815* (2013.01); *G03G 9/0817* (2013.01); *G03G 9/0819* (2013.01); *G03G 9/083* (2013.01); *G03G 9/08755* (2013.01); *G03G 9/08791* (2013.01); *G03G 9/08797* (2013.01)

USPC ..... 430/110.4; 430/109.3

(58) Field of Classification Search

USPC ..... 430/109.3, 110.4

See application file for complete search history.

(56) References Cited

U.S. PATENT DOCUMENTS

| | | | | |
|---|---|---|---|---|
| 2002/0072006 | A1* | 6/2002 | Mizoo et al. | 430/108.22 |
| 2003/0027067 | A1 | 2/2003 | Higuchi et al. | |
| 2004/0005509 | A1 | 1/2004 | Iida et al. | |
| 2004/0229142 | A1 | 11/2004 | Dojo et al. | |
| 2009/0180809 | A1 | 7/2009 | Imura et al. | |
| 2010/0268496 | A1 | 10/2010 | Trebbels et al. | |

FOREIGN PATENT DOCUMENTS

| | | | |
|---|---|---|---|
| EP | 1176471 | A2 | 1/2002 |
| EP | 1246023 | A2 | 10/2002 |
| EP | 1349013 | A2 | 10/2003 |
| EP | 1467259 | A1 | 10/2004 |
| EP | 2063332 | A1 | 5/2009 |
| JP | 8-123093 | A | 5/1996 |

(Continued)

OTHER PUBLICATIONS

Extended European search report dated Oct. 7, 2013 in corresponding European application No. 13172453.6.

(Continued)

*Primary Examiner* — Peter Vajda

(74) *Attorney, Agent, or Firm* — Knobbe Martens Olson & Bear LLP

(57) ABSTRACT

A toner for magnetic single-component development, which contains at least a binder resin which is a polyester resin, magnetic powder, and a charge control resin, wherein the ratio (%) of the area of the charge control resin present on the surface of the toner particles with respect to the area of the toner particles on an electron microscope image is made to be in a predetermined range corresponding to the particle diameter of the toner particles.

3 Claims, 1 Drawing Sheet

(56) References Cited

FOREIGN PATENT DOCUMENTS

| | | | |
|---|---|---|---|
| JP | H09-062025 | A | 3/1997 |
| JP | H10-177274 | A | 6/1998 |
| JP | 2006-071869 | A | 3/2006 |
| JP | 2006-154313 | A | 6/2006 |
| JP | 2008-009249 | A | 1/2008 |

OTHER PUBLICATIONS

Notice of Reasons for Rejection issued to JP Application No. 2012-139117, mailed Aug. 19, 2014.

* cited by examiner

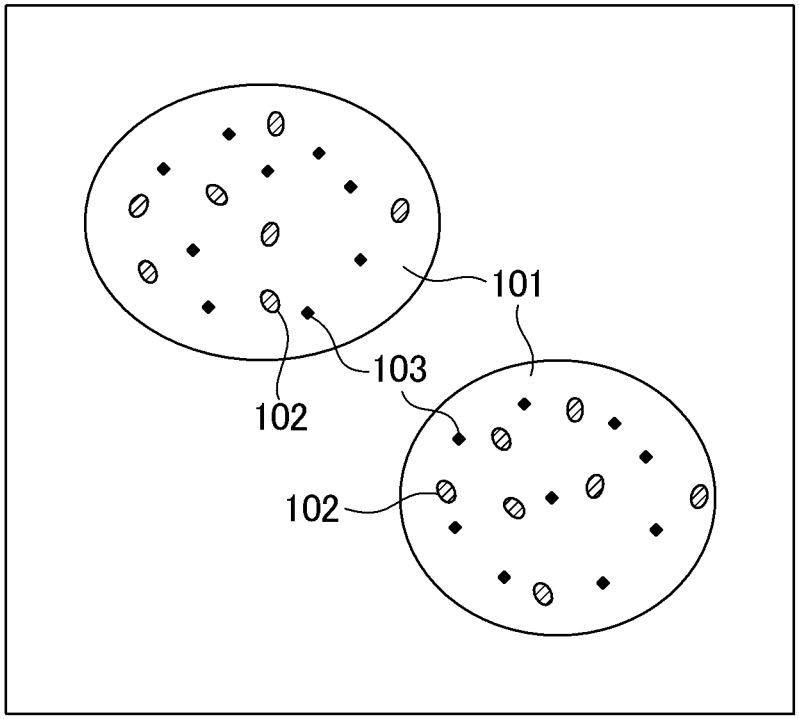
101
103
102
102

TONER FOR MAGNETIC SINGLE-COMPONENT DEVELOPMENT

INCORPORATION BY REFERENCE

This application is based upon and claims the benefit of priority from the corresponding Japanese Patent Application No. 2012-139117, filed in the Japan Patent Office on Jun. 20, 2012, the entire contents of which are incorporated herein by reference.

FIELD

The present disclosure relates to a toner for magnetic single-component development.

BACKGROUND

In general, in electrophotography, the surface of a photoconductor drum is charged by a method such as corona discharge, followed by exposure using a laser etc. to form an electrostatic latent image. The formed electrostatic latent image is developed with a toner so as to form a toner image. The formed toner image is transferred onto a recording medium to obtain an image with high quality. The toner used for formation of a toner image is typically toner particles (toner base particles) with an average particle diameter of 5 μm or larger and 10 μm or smaller produced by mixing a binder resin such as thermoplastic resin with components such as a colorant, a charge control agent and a release agent, followed by a kneading step, a pulverization step, and a classification step. For the purpose of providing flowability or suitable charging performance for the toner, and/or for facilitating cleaning of the toner from the surface of the photoconductor drum, silica and/or inorganic fine particles such as those of titanium oxide are externally added to the toner.

A two-component development method using a toner and a carrier such as iron powder, and a magnetic single-component development method using a toner containing magnetic powder inside the toner without using a carrier are known as dry development methods to be employed in various forms of electrophotography which are used in practice. Toners containing magnetic powder used in the magnetic single-component development method (hereinafter, also referred to as magnetic toner) have merits including low cost and excellent durability.

Furthermore, toner is required to have a smaller particle diameter due to the recent demand for higher image quality. By allowing the toner to have a smaller diameter, reproduction of thin lines is improved, and thus the image quality of the formed image is improved.

However, in the toners whose particle diameters are smaller, charge control agents and release agents are often contained in the toners in a state in which they are separated from the toner particles. Therefore, by using the toners whose particle diameters are reduced, a filming phenomenon occurs in which toner components are attached onto the surface of a photoconductor drum. When the filming phenomenon occurs, images having a desired image density accordingly do not tend to be formed easily, and image defects such as fogging tend to appear in the formed images in some cases.

As regarding the magnetic toner, as a toner in which problems caused by such a filming phenomenon have been resolved, a magnetic toner, including at least a binder resin, a magnetic powder and a charge control agent, in which an elution amount C (g/g) of the charge control agent measured by a certain method and a specific surface area Sw ($cm^2/cm^3$) obtained from the weight average diameter satisfy a predetermined relation, has been proposed.

However, in the above-mentioned magnetic toner, a selective development in which a toner having a smaller particle diameter is preferentially developed tends to occur. When image formation is carried out repeatedly for a long time, since toner particles with smaller diameters are consumed preferentially because of the selective development, the average particle diameter of toners in a developing device becomes larger. Consequently, by using the above-mentioned magnetic toner, image quality of thin lines formed after repetitive image formation easily deteriorates as compared to images of thin lines formed in the early stage.

SUMMARY

A toner for magnetic single-component development in accordance with the present disclosure contains at least a binder resin, a magnetic powder, and a charge control resin. The binder resin is polyester resin. As regards the toner for magnetic single-component development of the present disclosure, on an electron microscope image photographed at a magnification of 10,000×, the ratio of the area of the charge control resin present on the surface of the toner particles with respect to the area of the toner particles is 2.0% or more and 3.4% or less in toner particles having a particle diameter of 4 μm or larger and smaller than 6 μm, 3.7% or more and 5.6% or less in toner particles having a particle diameter of 6 μm or larger and smaller than 8 μm, and 5.7% or more and 8.1% or less in toner particles having a particle diameter of 8 μm or larger and 10 μm or smaller.

BRIEF DESCRIPTION OF DRAWINGS

FIG. 1 is a schematic view showing the state of the surface of toner particles for magnetic single-component development on an electron microscope image in accordance with the present disclosure.

DETAILED DESCRIPTION

Hereinafter, the present disclosure is explained in detail with reference to embodiments thereof. The present disclosure is not limited at all to the embodiments and may be carried out by appropriately making a change within the purpose of the present disclosure. Explanations may be occasionally omitted with respect to duplicated matters but this does not limit the essence of the present disclosure.

The toner for magnetic single-component development of the present disclosure (hereinafter, also abbreviated as "toner") includes at least a binder resin which is a polyester resin, a magnetic powder, and a charge control resin. The ratio of the area of the charge control resin present on the surface of the toner particles with respect to the area of the toner particles on an electron microscope image is in a predetermined range corresponding to the particle diameter of the toner particles.

The toner of the present disclosure may contain components such as a colorant and a release agent, if necessary, in addition to the binder resin, the magnetic powder, and the charge control resin. Furthermore, the surface of the toner of the present disclosure may be processed with the use of an external additive if necessary. Hereinafter, the binder resin, the magnetic powder, the charge control resin, the colorant, the release agent, and the external additive, which are essential or optional components constituting the toner for magnetic single-component development of the present disclosure, as well as a method of manufacturing the toner for magnetic single-component development are described sequentially.

Binder Resin

The toner of the present disclosure includes a polyester resin as a binder resin. When a polyester resin is used as the binder resin, a toner, which can be fixed excellently at a low temperature and which has excellent coloring property, is easily prepared. The polyester resins to be used as the binder resin may be appropriately selected from polyester resins which have been conventionally used as binder resins for toners.

Hereinafter, specific examples of the polyester resin are described. The polyester resin may be those obtained from condensation polymerization or condensation copolymerization of an alcohol component and a carboxylic acid component. The components to be used in synthesizing the polyester resin include divalent, trivalent or higher-valent alcohol components and divalent, trivalent or higher-valent carboxylic acid components, which are mentioned below.

Specific examples of the divalent, trivalent or higher-valent alcohols may be exemplified by diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, and polytetramethylene glycol; bisphenols such as bisphenol A, hydrogenated bisphenol A, polyoxyethylenated bisphenol A, and polyoxypropylenated bisphenol A; and trivalent or higher-valent alcohols such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Specific examples of the divalent, trivalent or higher-valent carboxylic acids include divalent carboxylic acids such as maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, or alkyl or alkenyl succinic acids including n-butyl succinic acid, n-butenyl succinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, isododecenylsuccinic acid; and trivalent or higher-valent carboxylic acids such as 1,2,4-benzene tricarboxylic acid (trimellitic acid), 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxypropane, 1,2,4-cyclohexane tricarboxylic acid, tetra (methylenecarboxyl)methane, 1,2,7,8-octanetetracarboxylic acid, pyromellitic acid, and Enpol trimer. These divalent, trivalent or higher-valent carboxylic acids may be used as ester-forming derivatives such as an acid halide, an acid anhydride, and a lower alkyl ester. Here, the term "lower alkyl" means an alkyl group of from 1 to 6 carbon atoms.

The softening temperature of a polyester resin is preferably 80° C. or higher and 150° C. or lower, and more preferably 90° C. or higher and 140° C. or lower.

A cross-linking agent or a thermosetting resin can be added to the polyester resin. By introducing a partial cross-linked structure into the polyester resin as the binder resin, properties of the toner such as storage stability, morphological retention, and durability can be improved without deteriorating fixability of the toner.

Preferable examples of the thermosetting resin usable in combination with the polyester resin are epoxy resins and cyanate resins. Specific examples of the preferred thermosetting resin may be exemplified by bisphenol-A type epoxy resins, hydrogenated bisphenol-A type epoxy resins, novolac-type epoxy resins, polyalkylene ether-type epoxy resins, cyclic aliphatic-type epoxy resins, and cyanate resins. These thermosetting resins may be used in a combination of two or more.

The glass transition temperature (Tg) of the polyester resin is preferably 50° C. or higher and 65° C. or lower, and more preferably 50° C. or higher and 60° C. or lower. In cases of using a toner including a polyester resin having an excessively low glass transition temperature as the binder resin, toners may be fused inside the development section of an image forming apparatus, or toners may be partially fused during delivery of toner containers or storage of toner containers in a storehouse or the like. In cases of using a toner including polyester resin having an extremely high glass transition temperature as the binder resin, because the strength of the polyester resin is low, toners may be easily attached to the latent image bearing member. When a toner including a polyester resin having an extremely high glass transition temperature is used as a binder resin, toners do not tend to be fixed excellently at a low temperature.

The glass transition temperature of the polyester resin may be determined from the change point of the specific heat of the polyester resin with a measuring method on the basis of JIS K7121 by using a differential scanning calorimeter (DSC). A more specific measuring method is described below. The glass transition temperature of the polyester resin can be measured by measuring the endothermic curve of the polyester resin using a differential scanning calorimeter DSC-6200 manufactured by Seiko Instruments Inc. as a measuring device. The sample to be measured (10 mg) is loaded into an aluminum pan and an empty aluminum pan is used as a reference. The glass transition temperature of the polyester resin may be determined from the obtained endothermic curve of the polyester resin which is obtained through measurement in the measuring temperature range from 25° C. to 200° C., at a temperature-increase rate of 10° C./min, and at normal temperature and normal humidity.

Magnetic Powder

The toner of the present disclosure is a magnetic toner and therefore essentially includes magnetic powder in the binder resin. Preferable examples of the magnetic powder to be blended in the binder resin may include iron such as ferrite and magnetite; ferromagnetic metals such as cobalt and nickel; alloys of iron and/or ferromagnetic metals; compounds of iron and/or ferromagnetic metals; ferromagnetic alloys which have undergone ferromagnetizing treatment, e.g. heat-treatment; and chromium dioxide.

Particle diameter of the magnetic powder is preferably 0.1 μm or larger and 1.0 μm or smaller, and more preferably from 0.1 μm or larger and 0.5 μm or smaller. A magnetic powder within this range of particle diameter may be easily dispersed into the binder resin.

In order to improve dispersibility of the magnetic powder into the binder resin, A magnetic powder which is surface-treated by a surface treatment agent such as a titanium coupling agent and a silane coupling agent may also be used.

The amount of the magnetic powder to be used is preferably 30 parts by mass or more and 50 parts by mass or less, and more preferably 35 parts by mass or more and 45 parts by mass or less based on 100 parts by mass of the total amount of the toner. In cases of using a toner where the content of the magnetic powder is excessively large, image density is unlikely to be maintained over a long period of time or it may be remarkably difficult to fix toner images. In cases of using a toner where the content of the magnetic powder is excessively small, fogging tends to appear in formed images or image density is unlikely to be maintained over a long period of time.

Charge Control Resin

The toner of the present disclosure essentially includes a charge control resin. Suitable examples of the charge control resin include resins having a quaternary ammonium salt, a carboxylic acid salt, or resins having a carboxyl group as a functional group.

More specific examples include styrene resins having a quaternary ammonium salt, acrylic resins having a quaternary ammonium salt, styrene-acrylic resins having a quaternary ammonium salt, polyester resins having a quaternary ammonium salt, styrene resins having a carboxylic acid salt, acrylic resins having a carboxylic acid salt, styrene-acrylic resins having a carboxylic acid salt, polyester resins having a carboxylic acid salt, styrene resins having a carboxylic group, acrylic resins having a carboxylic group, styrene-acrylic resins having a carboxylic group, and polyester resins having a carboxylic group. These resins may be oligomers or may be polymers.

Among such charge control resins, preferred resins are styrene-acrylic resins in which positively chargeable or negatively chargeable functional groups are introduced from the viewpoint that charge control resins can be easily dispersed in the binder resin in a desired state, and toners of which a charge control resin is attached on the surface of the toner particles can be easily manufactured.

Among resins that can be used as the positively chargeable charge control resins, styrene-acrylic resin having a quaternary ammonium salt as a functional group is more preferable from the viewpoint that a charged amount can be easily adjusted to have a value in the desired range. As the styrene-acrylic resins having a quaternary ammonium salt as a functional group, specific examples of acrylic comonomers to be copolymerized with the styrene unit include alkyl (meth) acrylate esters such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

As the quaternary ammonium salt, units derived from dialkylamino alkyl(meth)acrylate, dialkyl(meth)acrylamide, or dialkylamino alkyl (meth)acrylamide through a quaternization step are used. Specific examples of dialkylamino alkyl(meth)acrylate include dimethylamino ethyl(meth)acrylate, diethylamino ethyl(meth)acrylate, dipropylamino ethyl (meth) acrylate, and dibutylamino ethyl(meth)acrylate; specific examples of dialkyl(meth)acrylamide include dimethyl methacrylamide; and specific examples of dialkylamino alkyl (meth)acrylamide include dimethylpropyl methacrylamide. Furthermore, a polymerizable monomer containing a hydroxyl group such as hydroxyethyl(meth)acrylate, hydroxypropyl(meth)acrylate, 2-hydroxybuthyl(meth)acrylate, and N-methylol(meth)acrylamide can be used together when a monomer is polymerized.

Resins obtained by copolymerizing a carboxyl group, carboxylic acid base, and an unsaturated bond with the above-mentioned acrylic comonomers and styrene can be used as suitable negatively chargeable charge control resins. Specific examples of the monomer having an unsaturated bond having a carboxyl group or carboxylic acid base include acrylic acid, methacrylic acid, maleic acid, acrylic acid salt, methacrylic acid salt, and maleic acid salt. An alkali metal salt of carboxylic acid is preferable, and a sodium salt of carbonic acid or potassium salt of carbonic acid is more preferable as carboxylic acid salt contained in the carboxylic acid base. A combination of two or more kinds of these negatively chargeable charge control resins can be used.

The used amount of the positively chargeable or negatively chargeable charge control resin is typically preferably 1.5 parts by mass or more and 15 parts by mass or less, more preferably 2.0 parts by mass or more and 8.0 parts by mass or less, and particularly preferably 4.0 parts by mass or more and 7.0 parts by mass or less when the total amount of toner is 100 parts by mass.

When the amount of the charge control resin used is too small, the image density of formed images may be lower than a desired value because the charge rising property of the toner is not excellent in the early stage of image formation. When the amount of the charge control resin used is too large, toner charging defects easily occur, so that fogging easily occurs in the formed image.

Colorant

Since a toner in accordance with the first embodiment of the present disclosure includes magnetic powder as an essential component, the color of the toner is usually black. In order to adjust a formed image to the hue of more preferable black, the toner may include dye or pigment as a colorant. Specific examples of the pigment include carbon black; and specific examples of the dye include acid violet.

The amount of the colorant used is 1 part by mass or more and 20 parts by mass or less, and more preferably 1 part by mass or more and 10 parts by mass or less with respect to 100 parts by mass of binder resin.

Release Agent

The toner of the present disclosure may include a release agent for the purpose of improving fixability and offset resistance. The release agent to be added to the toner is preferably wax. Specific examples of the wax include polyethylene wax, polypropylene wax, fluorocarbon resin wax, Fischer-Tropsch wax, paraffin wax, ester wax, montan wax, and rice wax. These release agents may be used in a combination of two or more kinds thereof. Addition of these release agents to the toner permits efficient suppressing of offset or image smearing (dirt occurring in the periphery of the image when images are rubbed).

The used amount of the release agent is preferably 1 part by mass or more and 10 parts by mass or less when the total amount of the toner is 100 parts by mass. When the amount of the release agent used is too small, the desired effect may not be obtained in suppressing offset or image smearing; and when the amount of the release agent used is too large, the storage property of the toner may be deteriorated because of the fusing of the toners.

External Additive

The toner of the present disclosure may be surface-treated with an external additive if necessary. The type of the external additive may be appropriately selected from conventional external additives used for toners. Specific examples of the preferable external additive may include silica and metal oxides such as alumina, titanium oxide, magnesium oxide, zinc oxide, strontium titanate, and barium titanate. These external additives may be used in a combination of two or more kinds. Furthermore, these external additives may be used in a state in which they are made to be hydrophobic with the use of hydrophobic agents such as aminosilane coupling agent and silicone oil. When external additives which are made to be hydrophobic are used, it is possible to easily obtain toners in which a decrease in the charged amount at a high temperature and high humidity is easily suppressed and which have excellent flowability.

The amount of the external additive used is typically preferably 0.5% by mass or more and 5% by mass or less with respect to the total mass of the toner particles before the external additive is added.

Method of Manufacturing Toner for Magnetic Single-Component Development

A method for manufacturing a toner for magnetic single-component development is not particularly limited as long as the method can allow a charge control resin to be present in the desired state according to the particle diameter of toner particle. Specifically, the toner of the present disclosure is manufactured in such a manner that the ratio of the area of the charge control resin present on the surface of the toner particles with respect to the area of the toner particles on an electron microscope image photographed at a magnification of 10,000× is 2.0% or more and 3.4% or less in toner particles having a particle diameter of 4 μm or larger and smaller than 6 μm, 3.7% or more and 5.6% or less in toner particles having a particle diameter of 6 μm or larger and smaller than 8 μm, and 5.7% or more and 8.1% or less in toner particles having a particle diameter of 8 μm or larger and 10 μm or smaller.

A preferable method of manufacturing such a toner is described below. Firstly, a binder resin, magnetic powder and a charge control resin, as well as, if necessary, optional components such as a colorant and a release agent are mixed using a mixing device to obtain a mixture. Then, the obtained mixture is melt-kneaded using a kneading device such as a uniaxial or biaxial extruder to obtain a melt-kneaded product. After the obtained melt-kneaded product is cooled, the product obtained is pulverized, and the pulverized product is subjected to classification.

It is preferable that the above-mentioned classification processing includes a first classification step and a second classification step. In the first classification step, fine particles having a diameter of 3 μm or smaller are removed from the pulverized product; and in the first classification step, fine powders of the charge control resin detached from the binder resin occurring in the pulverization step to be further allowed to attach to the surface of the toner particles. In the second classification step, powder products obtained through the first classification step are classified so as to obtain a toner having the desired particle size distribution and average particle diameter.

In the first classification step, it is preferable that a rotor rotating type classifier is used. When the rotor rotating type classifier is used, toner fine particles in the pulverized product are easily classified and removed by the actions of the rotation of the rotor and air flowing in the machine. Preferable examples of the rotor rotating type classifier include devices such as TSP (manufactured by Hosokawa Micron Corporation) and TURBO-CLASSIFIER (manufactured by Nisshin Engineering Inc.).

Furthermore, the use of the rotor rotating type classifier permits attaching a charge control resin on the surface of the toner particles so that the ratio of the area of the charge control resin present on a surface of the toner particles with respect to the area of the toner particles is made to be in the predetermined range on the electron microscope image corresponding to the particle diameter of the toner particles.

As mentioned above, the ratio of the area of the charge control resin present on the surface of the toner particles with respect to the area of the toner particles on the electron microscope image becomes higher as the particle diameter of the toner becomes larger. In the first classification step using the rotor rotating type classifier, toner particles are revolving in the classifier at a high speed, and as the particle diameter of the toner particles is larger, the possibility that the revolving toner particles and fine particles of the charge control resin floating in the classifier collide with each other is higher. Therefore, when the first classification step is carried out by using the rotor rotating type classifier, as the particle diameter of the toner is larger, the above-mentioned ratio can be increased. In the first classification step, the above-mentioned ratio may be increased as the rotation speed of the rotor is increased. This is because as the flowing speed of toner particles in the classifier is higher, the fine particles of the charge control resin tend to be attached to the toner particles when the toner particles and fine particles of free charge control resins collide with each other.

When such a first classification step is carried out, fine powders of the toner are removed, and as the toner particles have a larger particle diameter, toner with a larger amount of the charge control resin attached to the surface thereof can be obtained in the predetermined range. The toner of the present disclosure is not susceptible to the bad effect due to a selective development in which toner having a smaller particle diameter is preferentially developed because the fine powders of the toner are removed in the first classification step. Furthermore, in the toner of the present disclosure, as the toner particles have a larger particle diameter, a larger amount of charge control resin is attached to the surface thereof, so that charging of the toner particles can be carried out to the desired charge amount. Also from such a factor, in the toner of the present disclosure, the above-mentioned selective development is suppressed.

Furthermore, the ratio of the area of charge control resins present on the surface of the toner particles with respect to the area of the toner particles on the electron microscope image (%, hereinafter, also referred to as "$RA^{CCR}$") can be measured by carrying out surface observation of the toner particles by using a scanning electron microscope (SEM) which enables energy dispersing type X-ray analysis (EDX).

In an electron microscope image of toner particles photographed using SEM, on the surface of the toner particles, as shown in FIG. 1, charge control resins 102 attached on or exposed to the surface of toner particles 101 are observed as a two-dimensional image together with other components such as magnetic powders 103. Then, by measuring the area of the toner particles 101 on the electron microscope image and the total area of the charge control resins 102 present on the surface of toner particles 101, $RA^{CCR}$ (%) can be calculated.

The following is a description of a specific method for measuring $RA^{CCR}$ (%) when the charge control resin is a positively chargeable charge control resin containing a nitrogen atom.

Method of Measuring $RA^{CCR}$ (%)

A sample is observed in a sight with a magnification of 10,000× under a scanning electron microscope (JSM-7600F (manufactured by Jeol Ltd.), and an electron microscope image is obtained. Each toner particle contained in the obtained electron microscope image is subjected to element mapping by using an energy dispersing type X-ray analyzer attached to the scanning electron microscope to detect a nitrogen atom derived from the charge control resin, and thus the charge control resin on the surface of the toner particles in the electron microscope image is specified. At least 10 toner particles having a particle diameter of 4 μm or larger and smaller than 6 μm, toner particles having a particle diameter of 6 μm or larger and smaller than 8 μm, and toner particles having a particle diameter of 8 μm or larger and 10 μm or smaller included in the electron microscope image are subjected to image analysis, respectively. The particle diameter of the toner particles denotes a diameter corresponding to a circle calculated from the area of the toner particles, which can be measured by analyzing the image.

Specifically, the electron microscope image is subjected to image processing by using image analysis software (WINROOf (manufactured by Mitani Corporation)), the total area ($\mu m^2$) of the charge control resins attached to the surface of one toner particle to be measured in the electron microscope image and the area of the toner particles are measured for each toner particle. From the measurement results of the areas, according to the following formula, $RA^{CCR}$ (%) of each toner particle is calculated. For the toner particles having a particle diameter in each range, an average value of $RA^{CCR}$ (%) is calculated by the calculated $RA^{CCR}$ (%), and the calculated average value is defined as the $RA^{CCR}$ (%) of the toner particles having a particle diameter of each range.

(Calculation Formula of $RA^{CCR}$)

$$RA^{CCR}(\%)=(\text{total area } (\mu m^2) \text{ of charge control resins/ area } (\mu m^2) \text{ of toner particle})\times 100$$

After the first classification step, the toner is adjusted to have the desired particle diameter and particle size distribution by carrying out the second classification step. The classifier to be used in the second classification step is preferably an air flow type classifier. The average particle diameter of toner that has undergone the second classification step is generally preferably 5 μm or larger and 10 μm or smaller, and more preferably 7 μm or larger and 9 μm or smaller.

The powder product obtained though the classification process mentioned above is used as toner base particles, and an external additive may be attached to the surface of the toner base particles if necessary. Note here that in the present disclosure, particles to which an external additive is attached are referred to as "toner base particles." A method of attaching an external additive to the surface of the toner base particles is not particularly limited, and a method can be appropriately selected from conventionally known methods. Specifically, the mixing conditions are adjusted so that the external additive is not embedded into the surface of the toner base particles, and the process of the toner base particles using the external additive is carried out by mixing the toner base particles and the external additive using a mixer like a HENSCHEL MIXER or a NAUTOR MIXER.

By using the above-mentioned toner for magnetic single-component development of the present disclosure, it is capable of suppressing the problems of image density of the formed image being lower than that desired, of image defects like fogging occurring in the formed image, and the quality of the formed image being deteriorated in the case where image formation is carried out for a long time. Therefore, the toner for magnetic single-component development of the present disclosure is preferably used for various image formation devices which employ the magnetic single-component development method.

EXAMPLES

The present disclosure is explained more specifically with reference to examples below. Note here that the present disclosure is not limited to the scope of the Examples.

In Examples and Comparative Examples, polyester resin used as a binder resin and a charge control resin were produced according to the below-mentioned Production Examples 1 and 2.

Production Example 1

Production of Polyester Resin 1960 g of propylene oxide adduct of bisphenol A, 780 g of ethylene oxide adduct of bisphenol A, 257 g of dodecenyl succinic anhydride, 770 g of terephthalic acid, and 4 g of dibutyl tin oxide were placed in a reactor vessel. The temperature of the inside of the reactor vessel was increased to 235° C. in a nitrogen atmosphere, and reaction was carried out for eight hours at the same temperature. Then, the pressure in the reactor vessel was reduced to 8.3 kPa, and then reaction was carried out for one hour at the same temperature. Then, the reacted product was cooled to 180° C., and then trimellitic anhydride was added into the reactor vessel so as to adjust the acid value of the polyester resin to about 10 mgKOH/g. Thereafter, the temperature of the content in the reactor vessel was increased to 210° C. at the speed of 10° C./hour, and the reaction was carried out at the same temperature to obtain a polyester resin.

Production Example 2

Production of Charge Control Resin

A 3 L-volume flask equipped with a stirrer, a capacitor, a thermometer, and a nitrogen introducer was used as a reactor vessel. 1000 g of pure water and 4 g of sodium dodecyl sulfate (SDS) as an emulsifying agent were placed into the reactor vessel, followed by carrying out nitrogen substitution for 30 minutes. Then, 2 g of potassium peroxodisulphate (KPS) was added into the reactor vessel and dissolved by stirring thereof. Nitrogen gas was introduced into the reactor vessel for creating a nitrogen atmosphere inside the reactor vessel, and the temperature of the content of the reactor vessel was increased to 80° C. Thereafter, while the temperature was maintained at 80° C., a mixed monomer composed of 300 g of styrene and 60 g of 2-ethylhexyl acrylate (2-EHA), an aqueous solution obtained by dissolving 40 g of 2-acrylamido-2-methyl propane sulfonic acid (AAPS) into 600 g of pure water were individually dropped into the vessel over two hours. Thereafter, while the temperature was maintained at 80° C., polymerization was carried out for eight hours. Next, the content was dried with a vacuum dryer at 50° C. until the moisture content became 1% or less to obtain a styrene-acryl copolymer as the charge control resin.

Examples 1 to 7 and Comparative Examples 1 to 6

Production of Toner Base Particles

Forty-five parts by mass of binder resin (polyester resin obtained in Production Example 1), 5 parts by mass of a release agent (carnauba wax (manufactured by S. Kato & Co.)), 5 parts by mass of a charge control resin (styrene-acryl copolymer obtained in Production Example 2), and 45 parts by mass of magnetic powder (magnetite TN-15 (manufactured by Mitsui Mining & Smelting Co., Ltd)) were mixed using a HENSCHEL MIXER. The mixture obtained was melt-kneaded using a biaxial extruder and then cooled. The melt-kneaded product obtained was coarsely pulverized using a hammer mill (Feather Mill FM-1 type (manufactured by Hosokawa Micron Corporation)). The coarsely pulverized product obtained was finely pulverized by using a mechanical pulverizer. Thereafter, by using a rotor rotating type classifier (200TSP (manufactured by Hosokawa Micron Corporation)), first classification was carried out at the revolution rate (rpm) described in Tables 1 and 2 to classify and remove fine particles from the finely pulverized product. Furthermore, the first classified finely pulverized product was subjected to second classification using an air flow classifier (DSX-2 (Nippon Pneumatic Mfg. Co., Ltd. Japan) to obtain toner base particles having a volume particle diameter of 7.0 μm or larger and 9.0 μm or smaller.

(Preparation of Toner)

Toner base particles and hydrophobic silica (RA-200 (manufactured by Nippon Aerosil Co., Ltd.), which amounted to 1.0% by mass with respect to the mass of the toner base particles, were mixed using a HENSCHEL MIXER (FM-20B (manufactured by Nippon Coke & Engineering Company, Limited)) for 10 minutes to obtain toners of Examples 1 to 7 and Comparative Examples 1 to 6.

Hereinafter, according to the following procedure the toners of Examples 1 to 7 and Comparative Examples 1 to 6 were measured for the ratio of the area of the charge control resin with respect to the area of the toner particles on the electron microscope image (%, also referred to as $RA^{CCR}$ (%)). The measurement results are shown in Tables 1 and 2.

Ratio of Charge Control Resin ($RA^{CCR}$)

The obtained toner particles were observed using a magnification of 10,000× under a scanning electron microscope (JSM-7600F (manufactured by Jeol Ltd.)), and an electron microscope image was obtained. Each toner particle contained in the electron microscope image obtained was subjected to element mapping by using an energy dispersing type X-ray analyzer attached to the scanning electron microscope to detect a nitrogen atom derived from the charge control resin so as to specify the charge control resin on the surface of the toner particles in the electron microscope image. Ten toner particles having a particle diameter of 4 μm or larger and smaller than 6 μm, toner particles having a particle diameter of 6 μm or larger and smaller than 8 μm, and toner particles having a particle diameter of 8 μm or larger and 10 μm or smaller included in the electron microscope image were subjected to image analysis, respectively. The particle diameter of a toner particle denotes the diameter corresponding to a circle calculated from the area of the toner particle, which can be measured by analyzing the image.

Specifically, the electron microscope image was subjected to image processing by using image analysis software (WINROOf (manufactured by Mitani Corporation)), the total area ($\mu m^2$) of the charge control resins attached to the surface of one toner particle to be measured in the electron microscope image and the area ($\mu m^2$) of the toner particles were measured for each toner particle. The $RA^{CCR}$ (%) of each toner particle on the electron microscope image was calculated from the measurement results of the area, according to the following formula. From the calculated $RA^{CCR}$ (%) relating to a plurality of toners to be measured, the average value of the $RA^{CCR}$ (%) of the toner particles having a particle diameter in each range was calculated and the calculated average value was defined as the $RA^{CCR}$ (%) of toner particles with a particle diameter in each range.

($RA^{CCR}$ Calculation Formula)

$$RA^{CCR}(\%)=(\text{total area } (\mu m^2) \text{ of charge control resins/ area of toner } (\mu m^2) \text{ particle})\times 100$$

TABLE 1

| | Example | | | | | | |
|---|---|---|---|---|---|---|---|
| | 1 | 2 | 3 | 4 | 5 | 6 | 7 |
| Charge control resin | | | | | | | |
| Amount (parts by mass) | 5.0 | 5.0 | 5.0 | 5.0 | 7.0 | 7.0 | 4.0 |
| Rotation speed at classification step (rpm) | | | | | | | |
| The first classification step | 5000 | 5250 | 5500 | 6000 | 5000 | 5500 | 6000 |
| $RA^{CCR}$(%) | | | | | | | |
| 4 μm or larger and smaller than 6 μm | 2.1 | 2.4 | 3.0 | 3.3 | 3.0 | 3.3 | 2.6 |
| 6 μm or larger and smaller than 8 μm | 3.9 | 4.4 | 4.9 | 5.3 | 3.9 | 4.9 | 4.2 |
| 8 μm or larger and 10 μm or smaller | 5.8 | 6.5 | 7.4 | 8.0 | 7.1 | 7.9 | 6.4 |

TABLE 2

| | Comparative example | | | | | |
|---|---|---|---|---|---|---|
| | 1 | 2 | 3 | 4 | 5 | 6 |
| Charge control resin | | | | | | |
| Amount (parts by mass) | 5.0 | 5.0 | 5.0 | 5.0 | 5.0 | 7.0 |
| Rotation speed at classification step (rpm) | | | | | | |
| The first classification step | 4500 | 4000 | 3500 | 6500 | — | — |
| $RA^{CCR}$(%) | | | | | | |
| 4 μm or larger and smaller than 6 μm | 1.8 | 1.2 | 0.9 | 3.6 | 3.7 | 6.9 |
| 6 μm or larger and smaller than 8 μm | 3.6 | 3.3 | 3.0 | 6.0 | 4.2 | 7.0 |
| 8 μm or larger and 10 μm or smaller | 4.9 | 4.4 | 4.2 | 8.4 | 4.4 | 7.5 |

Evaluation

The toners of Examples 1 to 7 and Comparative Examples 1 to 6 were evaluated for particle size distribution of the toners in the early stage and after successive formation of images, image density in the early stage and after successive formation of images, fogging density and image quality of thin lines. The results of the measurement of the particle size distribution of toners in the early stage and after successive formation of images, the image density in the early stage and after successive formation of images, the fogging density, and the image quality of thin lines are shown in Tables 3 and 4. Note here that a page printer (FS-4020DN (manufactured by KYOCERA Document Solutions)) equipped with an amorphous silicon drum (film thickness of amorphous silicon: 14 μm)) were used as an evaluation device.

Particle Size Distribution Measurement Method

The measurement of the particle size distribution of the toner (based on the volume) was carried out by using a Coulter counter MULTISIZER 3 (manufactured by Beckman Coulter, Inc.). ISOTON II (manufactured by Beckman Coulter, Inc.) was used as an electrolyte solution and a 100-μm aperture was used as an aperture. 10 mg of toner was added to a solution obtained by adding a small amount of the surface-active agent to the electrolyte solution (ISOTON II), and the toner was dispersed in the electrolyte solution by using an ultrasonic distributor so that the concentration displayed on the measurement device became 7% by mass or more and 9% by mass or less. The electrolyte solution in which toners were distributed was used as a measurement sample, the particle size distribution of the toner with respect to 50,000 toner particles was measured by using a Coulter counter multisizer 3 to obtain the volume distribution of the particle diameter of the toner. The median particle diameter (D50) and standard deviation (SD) were obtained from the obtained volume distribution of the particle diameters of the toner.

Image Density

Image evaluation patterns were formed on a medium to be recorded in a normal temperature and normal humidity environment (20° C., and 65% RH) by using the evaluation device to obtain an initial image. Thereafter, after 5000 sheets had been successively printed at a printing ratio of 4% in the normal temperature and normal humidity environment (20° C. and 65% RH), image evaluation patterns were formed on a medium to be recorded to obtain an image after successive image formation. Image density of solid image in the evaluation patterns formed as the initial image and the image after successive image formation, respectively, were measured using a reflection density measurement device (RD914 (manufactured by GretagMacbeth)). The image densities were evaluated according to the following standards.

Good (acceptance): 1.15 or more

Bad (not acceptance): less than 1.15

Fogging Density

The image densities of the non-imaged portions on the media, on which evaluation patterns of the initial image and the image after the successive image formation were formed, respectively, were measured using a reflection density measurement device (RD914). The value obtained by subtracting the image density of blank paper before being used for image formation from the image density of the non-imaged portion was defined as the fogging density. The fogging density was evaluated according to the following standard.

Good (acceptance): 0.010 or more

Bad (not acceptance): more than 0.010

Evaluation of Image Quality of Thin Lines (Maintenance of Image Quality)

In the evaluation of image quality of thin lines, thin line images formed in the early stage and thin line images formed after repeated image formation for a long time were compared with each other so as to evaluate whether or not thin lines having equal quality were formed.

The thin line images contained in the initial image used in the evaluation of image density, and the thin line images formed after successive image formation were observed by using a loupe with a magnification of 15×, the reproducibility of thin lines after successive image formation with respect to the thin line image in the early stage was evaluated based on the following standards.

Very good (acceptance): Thin line image having the equal quality to that of the initial image quality was formed.

Good (acceptance): Thin line image having substantially equal but slightly deteriorated quality as compared to the initial image quality was formed.

Bad (not acceptance): Thin line image having apparently deteriorated image quality as compared to the initial image quality was formed.

TABLE 3

| | Example | | | | | | |
|---|---|---|---|---|---|---|---|
| | 1 | 2 | 3 | 4 | 5 | 6 | 7 |
| $RA^{CCR}$(%) | | | | | | | |
| 4 μm or larger and smaller than 6 μm | 2.1 | 2.4 | 3.0 | 3.3 | 3.0 | 3.3 | 2.6 |
| 6 μm or larger and smaller than 8 μm | 3.9 | 4.4 | 4.9 | 5.3 | 3.9 | 4.9 | 4.2 |
| 8 μm or larger and 10 μm or smaller | 5.8 | 6.5 | 7.4 | 8.0 | 7.1 | 7.9 | 6.4 |
| Average particle size of toner in the early stage | | | | | | | |
| D50 | 8.2 | 7.1 | 8.0 | 7.8 | 6.9 | 8.1 | 7.3 |
| SD | 1.25 | 1.25 | 1.26 | 1.27 | 1.26 | 1.27 | 1.27 |
| Average particle size of toner after printing of 5,000 sheets | | | | | | | |
| D50 | 8.7 | 7.6 | 8.6 | 8.4 | 7.5 | 8.7 | 7.9 |
| SD | 1.27 | 1.26 | 1.27 | 1.27 | 1.27 | 1.28 | 1.28 |

TABLE 3-continued

| | Example | | | | | | |
|---|---|---|---|---|---|---|---|
| | 1 | 2 | 3 | 4 | 5 | 6 | 7 |
| Early stage | | | | | | | |
| Image density (Density/ Evaluation) | 1.25/ Good | 1.30/ Good | 1.32/ Good | 1.34/ Good | 1.29/ Good | 1.31/ Good | 1.28/ Good |
| Fogging (Density/ Evaluation) | 0.002/ Good | 0.001/ Good | 0.002/ Good | 0.003/ Good | 0.001/ Good | 0.002/ Good | 0.002/ Good |
| After printing of 5,000 sheets | | | | | | | |
| Image density (Density/ Evaluation) | 1.35/ Good | 1.31/ Good | 1.36/ Good | 1.40/ Good | 1.37/ Good | 1.36/ Good | 1.33/ Good |
| Fogging (Density/ Evaluation) | 0.003/ Good | 0.002/ Good | 0.003/ Good | 0.004/ Good | 0.002/ Good | 0.002/ Good | 0.003/ Good |
| Thin lines | Very Good | Good | Good | Good | Very Good | Good | Good |

TABLE 4

| | Comparative Example | | | | | |
|---|---|---|---|---|---|---|
| | 1 | 2 | 3 | 4 | 5 | 6 |
| $RA^{CCR}$(%) | | | | | | |
| 4 μm or larger and smaller than 6 μm | 1.8 | 1.2 | 0.9 | 3.6 | 3.7 | 6.9 |
| 6 μm or larger and smaller than 8 μm | 3.6 | 3.3 | 3.0 | 6.0 | 4.2 | 7.0 |
| 8 μm or larger and 10 μm or smaller | 4.9 | 4.4 | 4.2 | 8.4 | 4.4 | 7.5 |
| Average particle size of toner in the early stage | | | | | | |
| D50 | 8.1 | 6.9 | 8.0 | 8.0 | 7.1 | 8.0 |
| SD | 1.26 | 1.24 | 1.27 | 1.26 | 1.25 | 1.26 |
| Average particle size of toner after printing of 5,000 sheets | | | | | | |
| D50 | 9.2 | 8.2 | 8.9 | 8.7 | 9.5 | 10.4 |
| SD | 1.28 | 1.25 | 1.30 | 1.28 | 1.28 | 1.33 |
| Early stage | | | | | | |
| Image density (Density/ Evaluation) | 1.14/ Bad | 1.13/ Bad | 1.10/ Bad | 1.42/ Good | 1.30/ Good | 1.31/ Good |
| Fogging (Density/ Evaluation) | 0.001/ Good | 0.001/ Good | 0.001/ Good | 0.003/ Good | 0.003/ Good | 0.004/ Good |
| After printing of 5,000 sheets | | | | | | |
| Image density (Density/ Evaluation) | 1.39/ Good | 1.38/ Good | 1.39/ Good | 1.47/ Good | 1.41/ Good | 1.42/ Good |
| Fogging (Density/ Evaluation) | 0.005/ Good | 0.006/ Good | 0.007/ Good | 0.013/ Bad | 0.007/ Good | 0.008/ Good |
| Thin lines | Good | Good | Good | Good | Bad | Bad |

From Examples 1 to 7, it is shown that in the case where an image is formed for a long time by using a toner whose $RA^{CCR}$ (%) was 2.0% or more and 3.4% or less in toner particles having a particle diameter of 4 μm or larger and smaller than 6 μm; 3.7% or more and 5.6% or less in the toner particles having a particle diameter of 6 μm or larger and smaller than 8 μm; and 5.7% or more and 8.1% or less in the toner particles having a particle diameter of 8 μm or larger and 10 μm or smaller, the image density of the formed image can be maintained at the desired value, and occurrence of image defects such as fogging and reduction of image quality can be suppressed.

From Comparative Examples 1 to 3, it is shown that in the case of using a toner whose $RA^{CCR}$ (%) is too low in any of the toner particles having a particle diameter of 4 μm or larger and smaller than 6 μm, the toner particles having a particle diameter of 6 μm or larger and smaller than 8 μm, and the toner particles having a particle diameter of 8 μm or larger and 10 μm or smaller, the image density of the image formed in the early stage is lower than the desired value. This is because the charge increasing property of the toner in the early stage is not good because the charge control resin present on the surface of the toner particles is too small.

From Comparative Example 4, it is shown that when image formation is carried out for a long time by using a toner whose $RA^{CCR}$ (%) is too high in any of the toner particles having a particle diameter of 4 μm or larger and smaller than 6 μm, the toner particles having a particle diameter of 6 μm or larger and smaller than 8 μm, and the toner particles having a particle diameter of 8 μm or larger and 10 μm or smaller, image defects such as fogging easily occur. This is assumed to be because the charge control resin present on the surface of the toner particles is too large, and, as a result, the toner inside the developing device is excessively charged after image formation is carried out for a long time.

From Comparative Example 5, it is shown that when image formation is carried out repeatedly for a long time by using a toner whose $RA^{CCR}$ (%) is too high in the toner particles having a particle diameter of 4 μm or larger and smaller than 6 μm and a toner whose $RA^{CCR}$ (%) is too low in the toner particles having a particle diameter of 8 μm or larger and 10 μm or smaller, the image quality of the formed thin line image easily deteriorates as compared to the initial image quality. This is thought to be because toner particles with a smaller particle diameter, which have higher $RA^{CCR}$ (%) and which are more easily charged than toner particles with a larger particle diameter, which have a lower $RA^{CCR}$ (%), are preferentially developed. It is assumed that when the image formation is carried out for a long time by using the toner of Comparative Example 5, a selective development occurs, thus shifting the particle size distribution of the toner in the developing device towards a larger particle diameter.

From Comparative Example 6, it is shown that when image formation is repeatedly carried out by using a toner whose $RA^{CCR}$ (%) is too high in the toner particles having a particle diameter of 4 μm or larger and smaller than 6 μm and in the toner particles having a particle diameter of 6 μm or larger and smaller than 8 μm, the image quality of the formed thin line image is easily lowered as compared to the initial image quality. This is thought to be because toner particles having a smaller particle diameter, which have higher $RA^{CCR}$ (%) and which are easily charged, are preferentially developed. It is assumed that when the image formation is carried out by using the toner of Comparative Example 6 for a long time, a selective development occurs, thus shifting the particle size distribution of the toner in the developing device towards a larger particle diameter.

The invention claimed is:

1. A toner for magnetic single-component development, comprising at least a binder resin, magnetic powder, and a charge control resin, wherein the binder resin is a polyester resin, an amount of the charge control resin is from 4.0 parts by mass to 7.0 parts by mass when the total amount of toner is 100 parts by mass, the ratio of the area of the charge control resin present on the surface of the toner particles with respect to the area of the toner particles on an electron microscope image photographed at a magnification of 10,000× is 2.0% or more and 3.4% or less in toner particles having a particle diameter of 4 μm or larger and smaller than 6 μm, 3.7% or more and 5.6% or less in toner particles having a particle diameter of 6 μm or larger and smaller than 8 μm, and 5.7% or more and 8.1% or less in toner particles having a particle diameter of 8 μm or larger and 10 μm or smaller.

2. The toner for magnetic single-component development according to claim 1, wherein the charge control resin is a styrene-acrylic copolymer resin.

3. The toner for magnetic single-component development according to claim 1, wherein the toner for magnetic single-component development is a toner obtained through a pulverization step, then a first classification step using a rotor rotating type classifier, and a second classification step using an air flow type classifier.

* * * * *